United States Patent [19]

Pagliai et al.

[11] Patent Number: 4,702,416

[45] Date of Patent: Oct. 27, 1987

[54] AGITATOR REGULATOR VALVE

[76] Inventors: Ferro D. Pagliai, 1300 Mairette Rd., Pacific Palisades, Calif. 90272; Pedro W. Luchsinger, Kilometer 445 of the Panamericana Rd., Lagos de Moreno, Mexico, 047400

[21] Appl. No.: 791,778

[22] Filed: Oct. 28, 1985

[51] Int. Cl.[4] ..... B05B 9/04; B05B 9/08

[52] U.S. Cl. ..... 239/11; 239/126; 239/127; 239/142; 239/154; 239/333; 239/373; 222/130; 222/385; 222/397; 137/540

[58] Field of Search ..... 239/1, 11, 124, 126, 239/127, 142, 152, 153, 154, 331, 333, 373; 222/380, 385, 396, 397, 130; 137/524, 540, 543.17

[56] References Cited

U.S. PATENT DOCUMENTS

| | | | |
|---|---|---|---|
| 347,213 | 8/1886 | Walker | 137/540 X |
| 597,576 | 1/1898 | Gaskins | 222/385 |
| 669,819 | 3/1901 | Brooks | 222/396 |
| 924,501 | 6/1909 | Sala | 239/373 X |
| 1,125,263 | 1/1915 | Borkgren | 137/540 |
| 1,140,453 | 5/1915 | Frank | 222/385 |
| 1,428,928 | 9/1922 | Whaley . | |
| 1,783,882 | 12/1930 | Kohn | 222/385 |
| 1,787,751 | 1/1931 | Mathewson | 222/385 |
| 2,162,057 | 6/1939 | Brandt et al. | 239/154 |
| 2,192,256 | 3/1940 | Brandt | 222/385 |
| 2,284,316 | 5/1942 | Glass | 222/397 X |
| 2,569,903 | 10/1951 | Santarelli | 222/385 |
| 2,753,080 | 7/1956 | Bartlett | 222/82 |
| 3,094,281 | 6/1963 | Myers | 237/63 |

FOREIGN PATENT DOCUMENTS

| | | | |
|---|---|---|---|
| 600841 | 12/1959 | Italy | 239/331 |
| 4711 | 3/1892 | Switzerland | 239/154 |
| 201280 | 8/1923 | United Kingdom | 222/385 |
| 1412896 | 11/1975 | United Kingdom | 137/540 |

*Primary Examiner*—Andres Kashnikow
*Assistant Examiner*—Mary Beth O. Jones
*Attorney, Agent, or Firm*—Gausewitz, Carr & Rothenberg

[57] ABSTRACT

A pressure vessel for a backpack agricultural sprayer is mounted within a container of the sprayer and connected to the sprayer pump so that liquid from the container is forced under pressure into the pressure vessel for a spraying discharge therefrom. Sediment precipitated from herbicides or insecticides employing wettable powders tends to collect at the bottom of the pressure vessel and a combined sediment agitating and pressure regulating action is provided by a pressure regulator valve mounted in the pressure vessel and having a suction tube connected between the valve and the area of the pressure vessel where the precipitated sediment collects.

8 Claims, 3 Drawing Figures

AGITATOR REGULATOR VALVE

BACKGROUND OF THE INVENTION

The present invention relates to agricultural sprayers of pressurized liquids and more particularly concerns such a sprayer in which the liquid is agitated and its pressure controlled.

Pressurized discharge of various types of liquid insecticides, fertilizers, herbicides and other agricultural type treatment liquid has been accomplished by directly pressurizing a pressure vessel that is mounted within a portable liquid container, with a pump also connected to the container and pressure vessel. Liquid is drawn from the container, caused to flow under pressure into the pressure vessel and is sprayed therefrom under control of a spraying valve. Efficient spraying of agricultural insecticides, herbicides, and the like, requires control of the amount of insecticide dispensed as well as regulation of spraying pressure. All manufacturers of spraying chemicals recommend preferred use rates for efficient application of the chemicals. These rates specify the amount of chemical to be used per acre. However, the recommended rates can be met only if the spraying equipment is able to control the pressure output, the rate of output flow and the strength of the solution. For some materials, solution strength depends on the amount of non-soluble but wettable particles maintained in suspension within the solution. In such suspensions, agitation is required to minimize precipitation of solid particles so as to maintain solution strength.

Neither efficient pressure regulation nor practical agitation of suspensions of wettable powders has heretofore been available in portable agricultural sprayers.

Accordingly, it is an object of the present invention to provide for pressure regulation and/or agitation in the spraying of agricultural liquids.

SUMMARY OF THE INVENTION

In carrying out principles of the present invention, in accordance with a preferred embodiment thereof, an agricultural sparyer comprising a liquid container in which is mounted a pressure vessel, and having a pump for pressurizing the vessel with liquid drawn from the container, is provided with a combined pressure regulation and agitating apparatus. This is accomplished by mounting a pressure regulating valve in a wall of the pressure valve and connecting an input port of the regulating valve so as to withdraw sediment bearing liquid from a lowermost area of the pressure vessel, at which the precipitated sediment collects. Excess pressure in the pressure vessel is prevented by operation of the pressure regulating valve which discharges sediment bearing liquid from the bottom of the pressure vessel into the interior of the container where the previously precipitated particles can again go into suspension and can again be caused to flow under pressure to the interior of the pressure vessel.

DESCRIPTION OF THE PREFERRED EMBODIMENT

Figure 1:
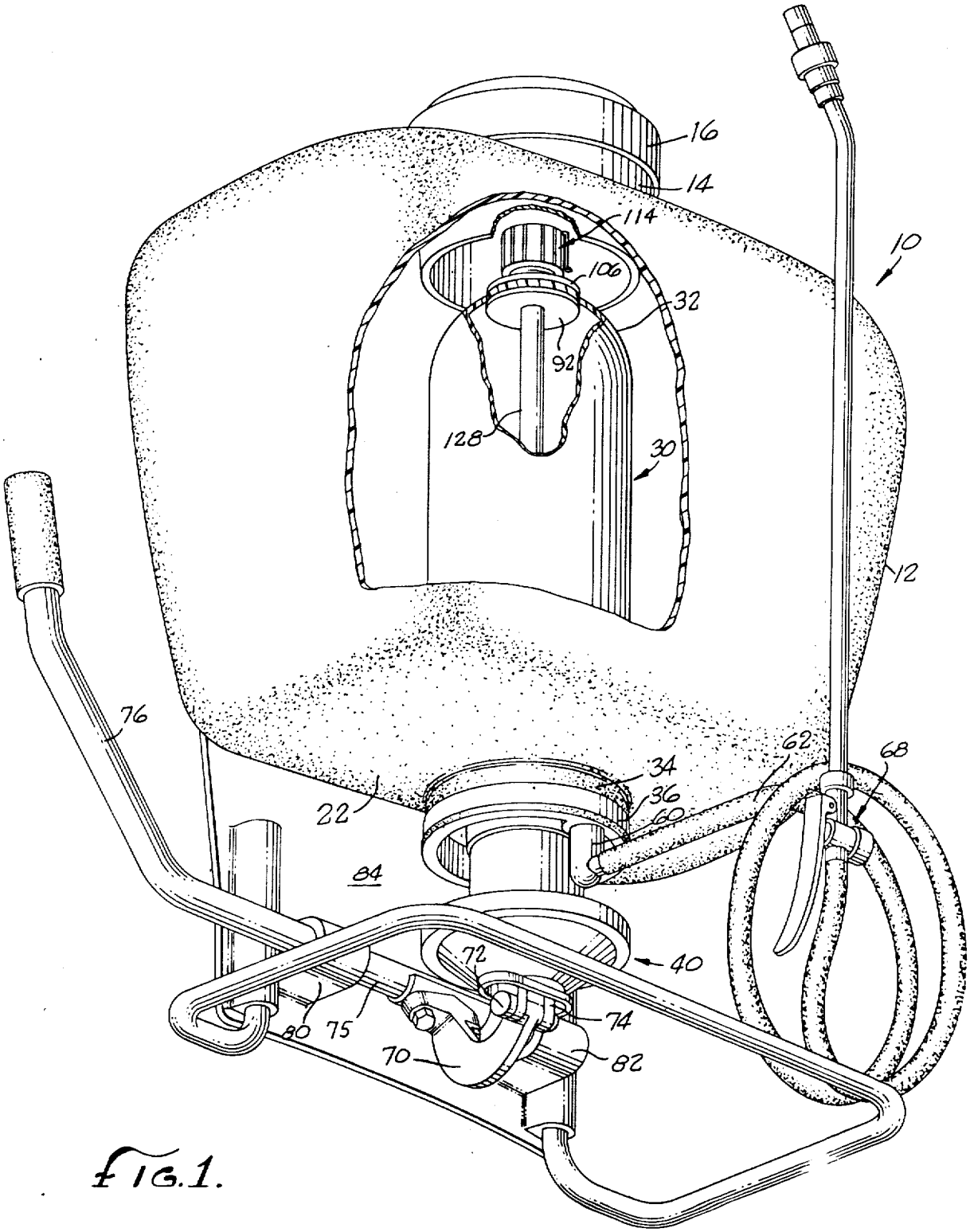
FIG. 1 is a pictorial illustration, with parts broken away, showing a backpack sprayer embodying principles of the present invention.
Figure 2:
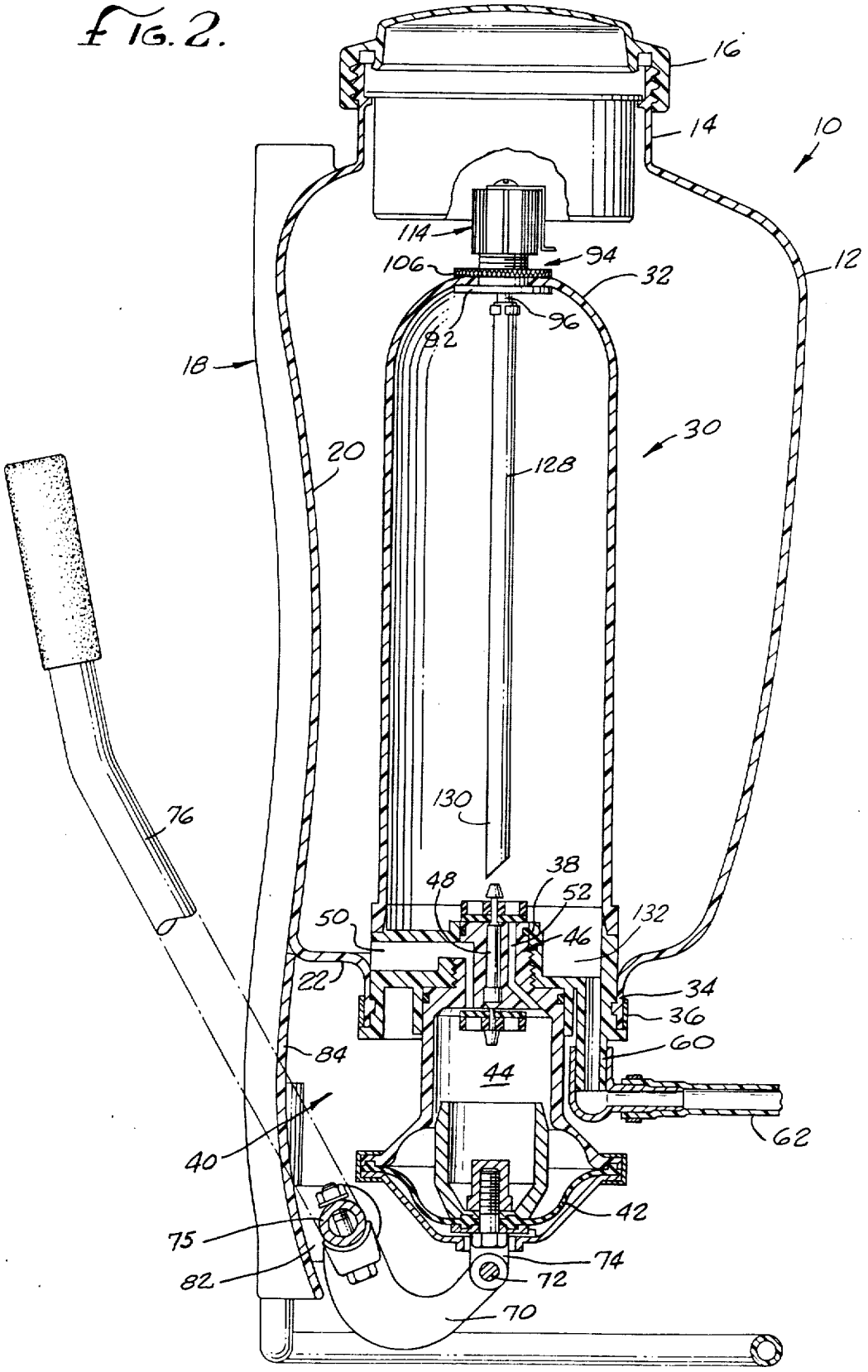
FIG. 2 is a sectional elevational view of the sprayer of FIG. 1.
Figure 3:
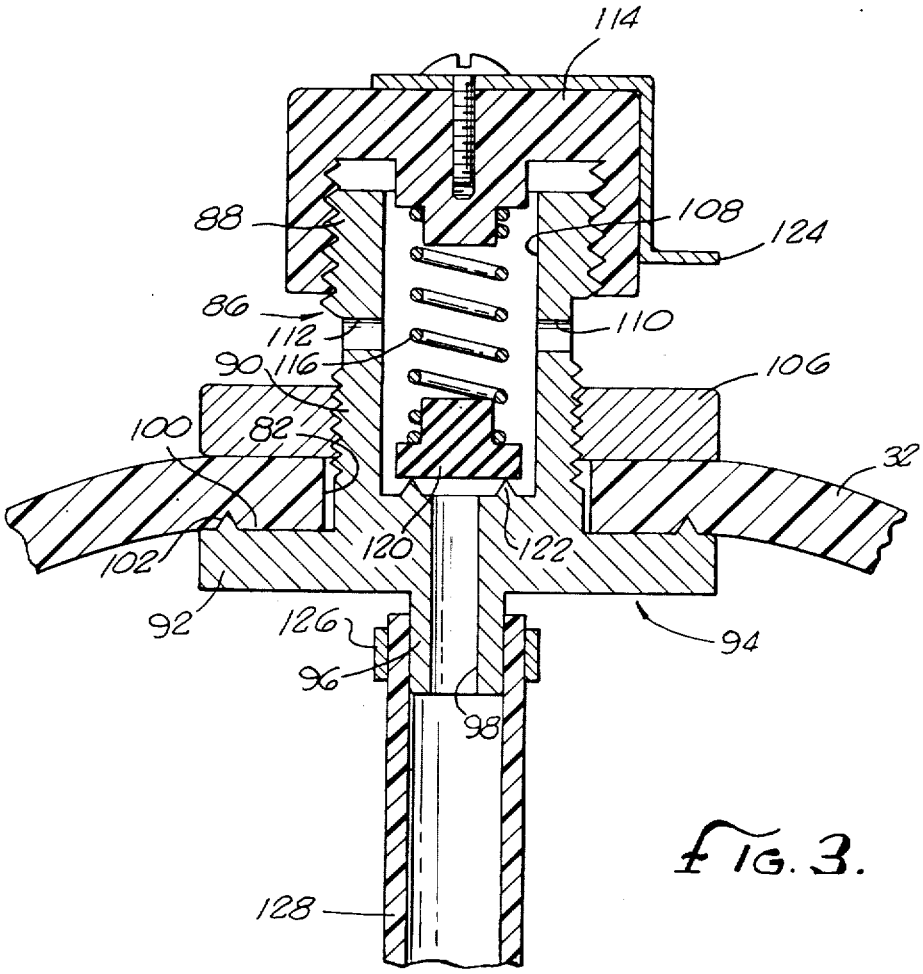
FIG. 3 is an enlarged fragmentary sectional view of the regulating valve shown in FIGS. 1 and 2.

As shown in FIGS. 1 and 2, a reservoir or container 10 is formed of a plastic body 12 having a fill neck 14 providing an opening that is closed and sealed by a detachable cap 16. A back supporting panel 18 is fixed to the forward wall portion 20 of the container and extends downwardly for a significant distance below the bottom 22 of the container.

A vertically elongated pressure vessel 30 extends from an upper portion 32 substantially vertically and downwardly to be securely mounted in a depending skirt portion 34 of the container 12. A container-circumscribing clamp 36 fixedly but detachably secures the pressure vessel to and within the container skirt. The lower end of the pressure vessel is formed with an internally threaded fitting 38 which threadedly receives a valve and pump assembly 40. Details of the valve and pump assembly form no part of the present invention. In the illustrated embodiment, the pump is a diaphragm pump, operated by a diaphragm 42 which pressurizes and depressurizes a pumping chamber 44 that is connected to a valve assembly 46. Assembly 46 has a valve operating spindle 48 which controls flow of liquid from the interior of the container into the pumping chamber via a passage 50, and also controls flow of pressurized liquid from the pumping chamber into the interior of the pressure vessel via a passage 52.

Pressurized liquid from the interior of the pressure vessel is discharged from a depressed area at the bottom of the pressure vessel via a vessel discharge fitting 60, to which is connected a discharge hose 62 having a manually operable discharge control valve 68 (FIG. 1).

The pump diaphragm is reciprocated (vertically in the illustration of FIG. 2) by connection to an actuator link 70 which is pivoted at 72 to a set of ears 74 that are fixedly connected to the center of the diaphragm. Link 70 is fixedly connected to a horizontal arm 75 of a pump operating handle 76 with the horizontal arm 75 being journaled in lugs 80, 82 fixedly carried by a sprayer panel lower section 84.

The structure described to this point operates in response to pivotal reciprocation of the handle 76 to draw liquid from the interior of container 12 into the pumping chamber 44 and to flow liquid under pressure from the pumping chamber into the thus pressurized interior of pressure vessel 30. Manual operation of valve 68 then allows discharge of spraying liquid from the pressure vessel.

In most commonly employed backpack sprayers of the type described up to this point, no pressure regulation has been provided, so that the operator may have little or no idea of the amount of pressure within the pressure vessel. In those sprayers (not shown) where the manually operated pump is replaced by a motor driven pump, the problem is even more significant because pressures many build up more readily and pressurization may be more nearly continuous.

Another problem with the previous sprayers of the type described above is the tendency of those sprayable liquids which contain suspended rather than dissolved particles, including many insecticides and herbicides employing wettable powders, to precipitate particles to lower portions of the apparatus. When such precipitation occurs in sufficient quantity, the fluid discharged may be deficient in the desired insecticide or herbicide materials. Alternatively, with an arrangement of the pressure vessel where its discharge hose is connected to a low portion of the vessel, initial discharge of sprayable liquid which occurs after a period during which little or no spraying has taken place, may spray liquid having an excessively high content of precipitated sediment. Thus, in prior srayers, the spraying of suspended wettable powders is uneven, and may result in periods of spraying of solutions of either too high or too low a concentration of desired chemicals.

According to principles of the present invention, this uneven spraying and the lack of control of pressure of sprayed materials are both avoided or minimized to a significant extent. In a presently preferred embodiment of the invention, the pressure vessel is provided with a pressure regulator valve that automatically controls maximum pressure within the pressure vessel and, as the pressure regulator valve operates, it agitates precipitated sediment by recycling sediment from the pressure vesesl back into the surrounding unpressurized liquid container.

A pressure regulator, mounted on the top wall 32 of pressure vessel 30, includes a headed sleeve 94 having a hollow cylindrical body or hollow shank 86 that is externally threaded at outer end 88 and at an inner end 90. Integral with the hollow shank 86 is a head 92 in the form of a flat circular disk having a depending input passage fitting 96 through wich extends a valve input passage 98.

Formed on an upwardly facing surface 100 of the circular head 92 is a circumferential knife edge rib 102 which is adapted to contact and embed itself into the iner surface of upper wall 32 of the pressure vessel to form a tight continuous liquid seal. The sealing rib 102 and the entire headed sleeve 94 is drawn upwardly and tightly against the inner surface of the pressure vessel wall by a nut 106 threaded upon the inner threads at portion 90 of the headed sleeve shank.

The hollow shank has a bore 108 that communicates with an input passage 98 and which, via output passages 110, 112 in shank 86 communicates with the exterior of the pressure vessel and the interior of the container 12. A pressure regulating cap 114 is threaded upon the outer portion 88 of the shank and receives one end of a compression spring 116 extending through the shank bore and butting at its lower end upon a valve closure disk 120 which is pressed by the spring 116 into sealing engagement with a valve seat 122 formed at the lower end of the shank bore 108.

A pressure indicator pointer 124 is carried by the adjustable cap 114 to cooperate with pressure indicating indicia (not shown) formed on the upper surface of nut 106.

Connected to the end of valve input fitting 96 by means of a clamp 126 is a flexible suction tube 128 which in effect forms an input port for the regulator valve. Tube 128 has a lower most end thereof, indicated at 130, positioned as desired at a lower most portion of the pressure regulating vessel. Although positioned at a lower portion of the pressure vessel, the tube end 130 is spaced from the intake end of the discharge fitting 60 of the pressure vessel, which intake end is connected to a depressed portion 132 of the lower end of the pressure vessel.

In the absence of the described agitator/regulator apparatus, particles of wettable powders of many insecticides fungicides or herbicides will precipitate from suspension to settle at the bottom of the pressure vessel, and thus either be discharged as previously mentioned in excessively highly concentrated, or in excessively low concentrated solution. However, with the described pressure regulator and agitator arrangement, pressurization of the pressure vessel, whether by the manual pump illustrated or by a motor operated pump (not shown) to repetitively or continuously pressurize the vessel to a preselected pressure, will tend to increase the pressure within the vessel to a point at which pressure on the valve closure 120, transmitted through the suction tube 128, is sufficient to overcome the compressive force of spring 116 whereby the valve closure member lifts off its seat. Liquid then is discharged from the interior of the suction tube 128 through passage 98 through the bore of the headed sleeve and, via apertures 110, 112, to the unpressurized interior of container 12. Thus, no liquid is lost, the liquid is merely recirculated and, concomitantly, precipitated sediment is also recirculated and thereby put back into suspension.

Pump input passage 50 has its input end positioned in a lower part of the pressure vessel. Thus, sediment precipitated to the bottom of the container, within the container but outside of the pressure vessel, is drawn into the pumping chamber and then caused to flow to the interior of the pressure vessel. This action of the pump continues a part of the agitating recirculation cycle to recirculate the relatively low pressure sediment bearing liquid from the container into the relatively high pressure vessel 30, whereas the action of the regulator valve recirculates sediment bearing liquid from the pressure vessel into the container, thereby forming a complete recirculation cycle.

The pressure at which the pressure valve will open is readily adjustable by rotation of adjustment cap 114 to increase or decrease the compressive force of spring 116. An approximate indication of the magnitude of the pressure limit is provided by the indicator 124 and indicia (not shown) on the nut 106.

The described apparatus and operation provide a unitary arrangement that affords two important functions in this type of spraying. The unitary apparatus provides pressure regulation, to insure spraying under recommended pressures, and, by the very action of the pressure regulation, precipitate is recirculated to thereby effectively agitate confined liquid. Agitation will occur as long as pumping action takes place and pressure within the vessel tends to exceed the preset limit. Thus, the agitation is not dependent upon the spraying operation at all, but merely upon the increase in pressure above the preselected value. In other words, the operation is such that whenever the pressure within the pressure vessel increases above the preselected value, the pressure is released and recirculating agitation takes place.

What is claimed is:

1. For use with a sprayer for dispensing liquids, said sprayer being of the type having a liquid container, a pressure vessel mounted in the container, a pump connected to the container and to the pressure vessel for pumping liquid from the container into the pressure vessel, and a fitting on the pressure vessel for discharging liquid under pressure, said pressure vessel having a low area in which precipitate tends to collect, agitation apparatus for said sprayer for regulating pressure within the vessel and for simultaneously withdrawing precipitate from said low area and recirculating such precipitate, said apparatus comprising:

pressure regulating means in said pressure vessel body having an output port for discharging fluid into the interior of said container, and means for flowing precipitate and liquid from said low area to said pressure regulating means for discharge from the pressure vessel into the container when pressure within the pressure vessel exceeds a preset limit, said means for flowing precipitate and liquid including an input port positioned adjacent said low area whereby sediment bearing liquid flows to said input port for discharge through the pressure regulator means into the container when pressure in the pressure vessel exceeds a predetermined limit, said pressure regulating means being mounted in said pressure vessel at a point remote from said low area and said input port comprising a liquid conduit connected between said low area and said pressure regulating means.

2. The apparatus of claim 1 wherein said container and pressure vessel are generally upright in normal use, and wherein said container has an access opening in an upper portion thereof, said pressure vessel having a top portion positioned adjacent said container access opening and accessible therefrom, said pressure regulating means being positioned at said pressure vessel top portion for access from said container top portion, said liquid conduit extending downwardly within said pressure vessel from said pressure regulating means to said low area.

3. The apparatus of claim 2 wherein said pressure vessel has an aperture in said top portion thereof, said pressure regulating means comprising a headed sleeve having a head positioned within said pressure vessel and a body portion extending upwardly through said pressure vessel aperture, valve means in said headed sleeve, means for securing said headed sleeve to said pressure vessel top portion, said sleeve having a discharge port in fluid communication with the interior of said container, and means for controlling operation of said valve, said headed sleeve having an input passage connected to said valve, said liquid being connected to said input passage of said pressure regulating means.

4. The apparatus of claim 2 wherein said pressure regulator means comprises a wall of said pressure vessel having an aperture therethrough, a headed fitting having a head position against said wall within said pressure vessel and having a body extending through said aperture to the exterior of said pressure vessel and adapted to extend into the interior of said container, said headed fitting having a plurality of sealing ribs on said head and pressed into the interior surface of said pressure vessel wall, a nut threaded on said headed fitting body drawing said head and a sealing rib against said pressure vessel wall to cause said sealing rib to be embedded in said wall, an input passage extending through said sleeve head into the interior of said fitting, a valve seat formed at one end of said input passage, a valve closure member positioned to be seated upon said fitting, a pressure adjusting cap threaded on an end of said fitting, a spring interposed between said cap and said valve closure member for pressing said closure member against said valve seat with selectively adjustable force, and output ports in said fitting body for discharging liquid to the exterior of said pressure vessel.

5. A pressure regulator vessel for use within a liquid container of a sprayer of wettable powders, said container being connected to a pump for flowing liquid under pressure into said pressure regulator vessel from said container, said pressure regulator vessel comprising a vessel body, a pressure regulator valve mounted in an upper portion of said vessel body, and a suction tube connected to said pressure regulator valve at one end thereof and having the other end thereof positioned at a lower portion of said pressure vessel body, whereby pressure within said vessel exceeding a preset limit causes sediment and liquid to be drawn from the bottom of said pressure vessel for discharge through said pressure regulating valve and recirculation back into said container.

6. A method for recirculating and agitating the contents of a sprayer for dispensing liquids including suspensions of wettable powders of the type that tend to form precipitated sediment, the sprayer comprising a container for confining liquid to be sprayed, a pressure vessel within the container, and a pump for pumping liquid from the container into the pressure vessel to be discharged from the pressure vessel during a spraying operation, said pressure vessel being subject to accumulation of precipitated sediment at its bottom, said method being adapted to agitate the confined liquid by recirculation of sediment from the pressure vessel bottom to help maintain particles in suspension, said method comprising the steps of:

pressurizing the pressure vessel, and releasing pressure in said pressure vessel through a pressure regulator valve, said step of releasing pressure comprising:

sucking said sediment and liquid from the bottom of said pressure vessel through a pressure regulator input conduit, and discharging said sediment and liquid from said conduit through said pressure regulator valve and into said container said container including an access opening at an upper portion thereof, said pressure vessel having an upper portion adjacent said access opening, and including the steps of mounting said pressure regulator valve to the upper portion of the pressure vessel adjacent the access opening to facilitate adjustment of the pressure regulator valve, said step of discharging comprising discharging said sediment and liquid from output passages of the pressure regulator valve at the upper portion of the interior of said container and above the top of the pressure vessel.

7. A manually operated sprayer for dispensing liquid insecticides, herbicides or pesticides comprising a liquid container having a first sealable opening at an upper end thereof for receiving liquid to be dispensed from the container, and having a second opening at a lower end thereof, a pressure vessel mounted within said container and having a lower end sealed to said second opening, said pressure vessel having a pump-receiving fitting communicating with the interior thereof, said pressure vessel having a discharge fitting providing communication between the interior thereof and ambient atmosphere, a pump assembly having a pumping chamber and having a connecting portion at a first end thereof configured for being matingly received within said pump-receiving fitting for securing said pump assembly to the lower end of said pressure vessel within said pump-receiving fitting, said pump assembly connecting portion having first conduit means communicating with said pumping chamber and said pump-receiving fitting for flowing liquid from the container into said pumping chamber, said pump assembly connecting portion including second conduit means therethrough for flowing liquid under pressure from said pumping chamber to the interior of said pressure vessel, said pump assembly connecting portion including valve means for controlling flow through said first and second conduit means, means for operating said pump assembly to pressurize said pressure vessel, a pressure regulator valve connected to an upper portion of said pressure vessel and positioned adjacent to and accessible form said first sealable opening of said container, said pressure regulator valve having a discharge portion in liquid communication with the interior of said container and an input port for liquid communication with the interior of said pressure vessel, and a suction conduit connected to said input port and having a suction end positioned in said pressure vessel at said lower end thereof, whereby when pressure within said pressure vessel exceeds a predetermined limit, the pressure regulator valve opens to cause liquid and precipitated sediment at the bottom of said pressure vessel to be sucked upwardly through said suction conduit and through said regulator valve for discharge into an upper portion of said container.

8. A backpack sprayer for spraying agricultural insecticides, herbicides, and the like comprising:

a container adapted to confine a body of wettable powder, a pressure regulator vessel mounted within said container, and a pump connected with the container for flowing liquid under pressure into said pressure regulator vessel from said container, said pressure regulator vessel comprising:

a vessel body, a pressure regulator valve mounted in an upper portion of said vessel body, and a suction tube connected to said pressure regulator valve at one end thereof and having the other end thereof positioned at a lower portion of said pressure vessel body, whereby pressure within said vessel exceeding a preset limit causes sediment and liquid to be drawn from the bottom of said pressure vessel for discharge through said pressure regulating valve and recirculation back into said container.

* * * * *

UNITED STATES PATENT AND TRADEMARK OFFICE

CERTIFICATE OF CORRECTION

PATENT NO. : 4,702,416

DATED : October 27, 1987

INVENTOR(S) : Ferro D. Pagliai and Pedro Wirz Luchsinger

It is certified that error appears in the above-identified patent and that said Letters Patent is hereby corrected as shown below:

Claim 3 (column 5, line 43), following the word "liquid" sert ---conduit---.

Signed and Sealed this

Fifth Day of July, 1988

*Attest:*

*Attesting Officer*

DONALD J. QUIGG

*Commissioner of Patents and Trademarks*